US010794577B2

(12) United States Patent
Li et al.

(10) Patent No.: US 10,794,577 B2
(45) Date of Patent: Oct. 6, 2020

(54) LED DOWNLIGHT APPARATUS

(71) Applicant: XIAMEN ECO LIGHTING CO. LTD., Xiamen (CN)

(72) Inventors: Ke Li, Xiamen (CN); Xiaoliang Wen, Xiamen (CN); Maojin Zeng, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/229,060

(22) Filed: Dec. 21, 2018

(65) Prior Publication Data

US 2019/0195476 A1 Jun. 27, 2019

(30) Foreign Application Priority Data

Dec. 21, 2017 (CN) ..... 2017 2 1802139 U

(51) Int. Cl.

| | |
|---|---|
| ***F21V 21/04*** | (2006.01) |
| ***F21V 29/76*** | (2015.01) |
| ***F21K 9/237*** | (2016.01) |
| ***F21K 9/238*** | (2016.01) |
| ***F21V 7/06*** | (2006.01) |
| ***F21S 8/02*** | (2006.01) |
| ***F21V 29/71*** | (2015.01) |
| ***F21V 23/00*** | (2015.01) |
| ***F21V 29/505*** | (2015.01) |
| *F21Y 115/10* | (2016.01) |

(52) U.S. Cl.

CPC ..... *F21V 21/047* (2013.01); *F21K 9/237* (2016.08); *F21K 9/238* (2016.08); *F21S 8/026* (2013.01); *F21V 7/06* (2013.01); *F21V 23/007* (2013.01); *F21V 29/505* (2015.01); *F21V 29/71* (2015.01); *F21V 29/763* (2015.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 8,616,724 | B2 * | 12/2013 | Pickard | F21V 7/048 362/241 |
| 2012/0140466 | A1 * | 6/2012 | Yang | F21V 7/0008 362/235 |
| 2012/0187836 | A1 * | 7/2012 | Hashimoto | F21V 5/04 315/51 |
| 2012/0230041 | A1 * | 9/2012 | Mizuta | F21K 9/233 362/373 |
| 2014/0168992 | A1 * | 6/2014 | Xue | F21V 13/04 362/307 |
| 2016/0348861 | A1 * | 12/2016 | Bailey | F21S 8/026 |
| 2019/0360664 | A1 * | 11/2019 | Liu | F21V 29/75 |

* cited by examiner

*Primary Examiner* — Elmito Breval

(74) *Attorney, Agent, or Firm* — Chun-Ming Shih; Lanway IPR Services

(57) ABSTRACT

A LED downlight apparatus includes a light source plate, a heat sink, a reflective cup and a driver container. The reflective cup reflects light of the light source plate and the heat sink is arranged between the driver container and the light source plate.

18 Claims, 5 Drawing Sheets

LED DOWNLIGHT APPARATUS

FIELD

The present invention is related to a LED apparatus and more particularly related to a LED downlight apparatus.

BACKGROUND

Downlight devices are widely used in the world, but people still look for better design with low cost and better visual effect.

Therefore, in such crowded art, any improvement may bring a great advantages for human life.

SUMMARY OF INVENTION

In some embodiments, a LED downlight apparatus includes a light source plate, a heat sink, a reflective cup and a driver container.

The downlight apparatus is fixed to a cavity or an installation box of a ceiling. A part of the downlight apparatus is exposed and visible by users while the other part of the downlight apparatus is hidden in the ceiling.

Multiple LED chips, which may be packed in flip chip packaging or other packing methods, are mounted on the light source plate. Some driver circuit may be also mounted on the light source plate.

When all necessary driver circuit components are disposed on the light source plate, the driver container mentioned below may be removed.

In other words, the driver and the light source components may be divided into two parts in some embodiments and may be integrated together on the light source plate.

In some embodiments, the light source plate may include a metal substrate, an insulation layer and a wiring layer. The LED chips are electrically connected to the wiring layer so as to form an electrical loop connected in series, in parallel, or in series and in parallel. For the connection type of in series and in parallel, it means some LED chips are connected in series and multiple series connected LED chips are further connected in parallel, or in other ways, depending on design requirements and LED chip characteristics. For example, the LED chips are arranged to meet an external power source voltage so as to decrease the complexity of corresponding driver components.

The LED chips may include only one type of LED chips, e.g. emitting a light with the same spectrum and/or color temperature. In some other embodiments, the LED chips may include multiple types of LED chips, e.g. with different color temperatures, color or other optical parameters.

When multiple types of LED chips, the LED chips may be used for mixing one or more than one optical settings, like several color temperatures.

Furthermore, a manual switch may be connected to a driver circuit for receiving a user operation to change color temperatures of the downlight apparatus. In some other embodiments, different driving currents or different duty ratio currents are supplied to the LED chips to mix desired optical parameters.

The light source play may be a circular flat plate or other geometrical structure. One side that facing down side with respect to a ceiling is called the bottom side. The bottom side of the light source plate is used for mounting the LED chips.

The heat sink includes a heat contact part and a heat dissipating part. The heat contact part is close to a heat source, like the light source plate, by directly or indirectly contacting the light source plate. For example, the heat contact part directly engages the light source plate. In some other designs, additional heat material like heat dissipation glue may be applied between the light source plate and the heat contact part of the heat sink.

The heat contact part may have a contact area with similar shape as the light source plate for the two parts to engage more closely.

The heat sink includes a heat contact part and a heat dissipating part. In some embodiments, the heat contact part has a shape corresponding to the light source plate. For example, the heat contact part may have a contact area with similar shape as the light source plate for the two parts to engage more closely. In some other embodiments, the heat contact part is a ring structure directly or indirectly engaging a peripheral area of the light source plate.

Some heat dissipating material, like glue, may be applied to further enhance heat transmission between the heat contact part of the heat sink and the light source plate.

Heat received from the heat contact part of the heat sink is further transmitted to the heat dissipating part. The heat dissipating part further transmits received heat to one or more other components.

In some embodiments, the heat sink is placed above the light source plate. Specifically, a bottom side of the heat contact part is heat connected to a top side of the light source plate. The term "heat connected" refer to heat conduction between two components with directly engagement or indirectly engagement with some other components like heat dissipating material placed between the two components.

The reflective cup includes a neck portion heat connected to the heat dissipating part. Specifically, in some embodiments, the reflective cup has a widen bottom edge and a narrow top edge. The neck portion refers to the area close to the narrow top edge. The reflective cup may have an opening corresponding to the shape of the light source plate.

In addition, the reflective cup has a top surface heat connected to the heat dissipating part of the heat sink. With such design, heat of the light source plate is carried from the heat contact part of the heat sink to the heat dissipating part of the heat sink. In addition, heat is further transmitted from the heat dissipating part of the heat sink to the reflective cup. The heat dissipating part of the heat sink may directly engage the top surface of the reflective part, or indirectly engage the top surface of the reflective cup, e.g. applying some heat dissipating glue between the top surface of the reflective cup and the heat dissipating part of the heat sink.

The reflective cup has an inner reflective surface surrounding the light source plate for reflecting a light emitting from the light source plate to predetermined directions. Specifically, the inner reflective surface may form a surrounding dome or cup shape with a light opening.

Light emitted from the light source plate may escape from the light opening directly, or be emitted to the inner reflective surface of the reflective cup and reflected for one or multiple times before the light is escaped from the light opening.

There may be a diffusion cover covering the light opening, or other designs like some mentioned below.

The inner reflective surface may be attached with reflective material like white paint, or disposed with optical guiding structures for showing shining surface or enhancing light reflection.

In some embodiments where driver circuits are not directly integrated with the light source plate, the driver circuits are placed in the driver container. The driver container may be a box of any geometrical shape, e.g. with a bottom shape similar to the top edge of the reflective cup and the light source plate.

In some embodiments, the driver container may also contain wireless or wire communication circuits and related processing circuits for converting an external command to a corresponding signal to control the LED downlight apparatus.

The driver circuit is electrically connected to the LED chips via a conductor path, e.g. wires or conductive strips. In some embodiments, the driver container may have a passing hole for the conductor path to pass through. Furthermore, the heat sink may also have a passing hole for the conductive path to route and to connect to the LED chips of the light source plate. In some embodiments, the passing hole may contain one or more sub holes corresponding to wire.

Plugging sockets may also be used for electrically connecting the driver circuit to the LED chips. The driving current converted by the driver circuit is sent to the LED chips.

The light source plate has a heat dissipating substrate for conducting heat of the LED chips to the heat contact part of the heat sink.

In some embodiments, the driver container engages a top side of the heat contact part of the heat sink. There are various ways to implement this feature. For example, the heat sink is arranged between the driver container and the light source plate. In such design, heat of the light source plate may also be transmitted to the driver container. When the driver container is made of metal material, the driver container may also be used for heat dissipation.

In some embodiments, the driver container has a bottom side and a lateral wall. At least a part of the lateral wall of the driver container engages the heat contact part of the heat sink. For example, when the driver container is a circular box, the bottom side of the circular box may engage a first part of the heat contact part of the heat sink and the lateral side are partly or completely engage a second part of the heat contact part of the heat sink.

For example, the heat contact part of the heat sink may be a cup shape structure so that the driver container is placed in the cup structure.

In some other embodiments, at least another part of the lateral wall is not contacting the heat sink. In such case, the driver container may not need to completely surrounded by the heat contact part of the heat sink.

In some embodiments, a heat sink height of the heat sink is less than 50% of a reflective cup height of the reflective cup. With the design mentioned above, the overall height of the LED downlight apparatus may be decreased.

In some embodiments, the heat sink may spread and cover most of the reflective cup. In some other embodiments, to decrease cost, the heat sink only covers part of the reflective cup, e.g. less than 50% of height of the reflective cup.

In some embodiments, the driver circuit is mounted on a circuit plate. The circuit plate is attached to the bottom side of the driver container. With such design, the heat of the driver circuit may easily carried away by the heat contact part, too.

In some embodiments, the reflective cup and the heat sink are circular shape structures.

In some embodiments, the inner surface of the reflective cup are disposed with polygonal structures.

Specifically, in a first design, the polygonal structures have convex protruding surface. Such design brings a first optical guiding and visual effect.

In some other design, the polygonal structures have concave surface, which brings a second optical guiding and visual effect.

The polygonal structures may look like fins of a fish or a crystal decoration.

In some embodiments, the polygonal structures close to the light source plate and away from the light source plate are different. For example, the polygonal structure may have different sizes for those near the top edge of the reflective cup compared to those near the bottom edge of the reflective cup.

In some embodiments, the heat sink forms a concave cup facing upwardly and the light source plate is placed in the concave cup. In such design, the reflective cup may have two inverted curve surfaces. The first curve surface forms a first cup for reflecting the light of the light source plate and the second curve surface forms a second cup for holding the driver container.

Such design may further decrease the overall height of the downlight apparatus.

In some embodiments, the reflective cup comprises a streamline bell shape structure.

In some embodiments, the downlight apparatus also has a shielding cover covering the light source plate. The light emitted from the plurality of LED modules passes through the shielding cover.

In some embodiments, the shielding cover has a bottom lens for forming a light beam and a lateral wall of the shielding cover for passing light on the reflective cover forming a second luminous source. For example, the light of the second luminous source emits to the inner reflective surface while the light via the bottom lens is directly emitting outside the LED downlight apparatus.

In some embodiments, the reflective cup has a hook structure for plugging and fixing the shielding cover. The hook may have an inverted hook to prevent detachment between the reflective cup and the light source plate.

In some embodiments, the downlight apparatus may also has a heat conductive layer disposed between the light source plate and the heat sink. Glue or other heat conductive material may be used for forming the heat conductive layer.

In some embodiments, the heat sink is made of metal material.

In some embodiments, the heat sink has a plurality of protruding bars on a surface of the heat sink to increase the rigidity of the heat sink and the reflective cover. Such protruding bars may form a grid or other shape to strengthen the rigidity of the attached reflective cup.

In some embodiments, the light source plate also engages an edge of the reflective cup.

DETAILED DESCRIPTION

Figure 1:
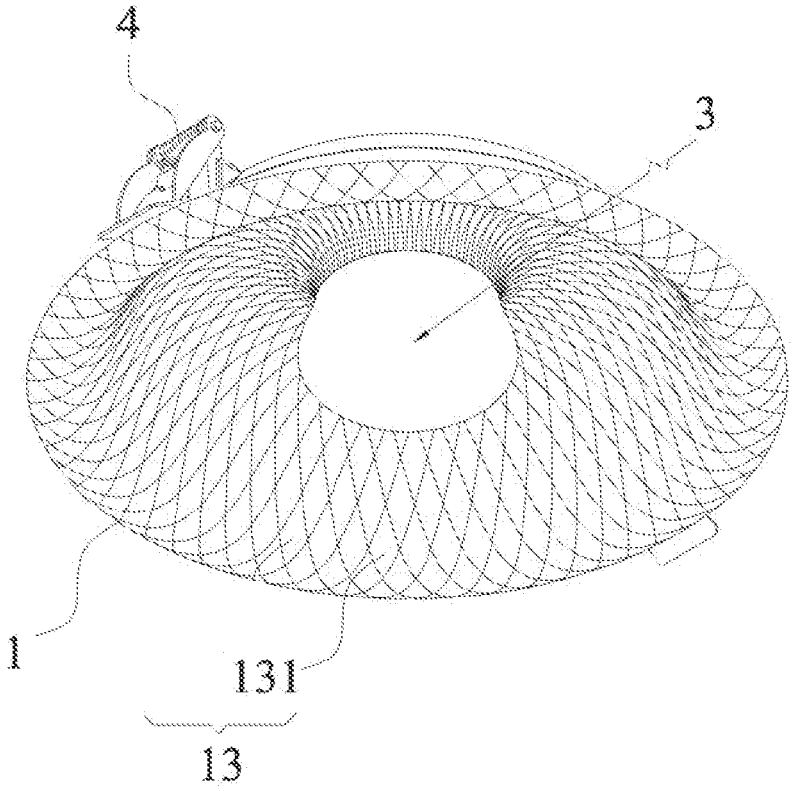
FIG. 1 is a perspective view of a LED downlight apparatus.

In some embodiments, a LED downlight apparatus includes a light source plate, a heat sink, a reflective cup and a driver container.

The downlight apparatus is fixed to a cavity or an installation box of a ceiling. A part of the downlight apparatus is exposed and visible by users while the other part of the downlight apparatus is hidden in the ceiling.

Multiple LED chips, which may be packed in flip chip packaging or other packing methods, are mounted on the light source plate. Some driver circuit may be also mounted on the light source plate.

When all necessary driver circuit components are disposed on the light source plate, the driver container mentioned below may be removed.

In other words, the driver and the light source components may be divided into two parts in some embodiments and may be integrated together on the light source plate.

In some embodiments, the light source plate may include a metal substrate, an insulation layer and a wiring layer. The LED chips are electrically connected to the wiring layer so as to form an electrical loop connected in series, in parallel, or in series and in parallel. For the connection type of in series and in parallel, it means some LED chips are connected in series and multiple series connected LED chips are further connected in parallel, or in other ways, depending on design requirements and LED chip characteristics. For example, the LED chips are arranged to meet an external power source voltage so as to decrease the complexity of corresponding driver components.

The LED chips may include only one type of LED chips, e.g. emitting a light with the same spectrum and/or color temperature. In some other embodiments, the LED chips may include multiple types of LED chips, e.g. with different color temperatures, color or other optical parameters.

When multiple types of LED chips, the LED chips may be used for mixing one or more than one optical settings, like several color temperatures.

Furthermore, a manual switch may be connected to a driver circuit for receiving a user operation to change color temperatures of the downlight apparatus. In some other embodiments, different driving currents or different duty ratio currents are supplied to the LED chips to mix desired optical parameters.

The light source play may be a circular flat plate or other geometrical structure. One side that facing down side with respect to a ceiling is called the bottom side. The bottom side of the light source plate is used for mounting the LED chips.

The heat sink includes a heat contact part and a heat dissipating part. The heat contact part is close to a heat source, like the light source plate, by directly or indirectly contacting the light source plate. For example, the heat contact part directly engages the light source plate. In some other designs, additional heat material like heat dissipation glue may be applied between the light source plate and the heat contact part of the heat sink.

The heat contact part may have a contact area with similar shape as the light source plate for the two parts to engage more closely.

The heat sink includes a heat contact part and a heat dissipating part. In some embodiments, the heat contact part has a shape corresponding to the light source plate. For example, the heat contact part may have a contact area with similar shape as the light source plate for the two parts to engage more closely. In some other embodiments, the heat contact part is a ring structure directly or indirectly engaging a peripheral area of the light source plate.

Some heat dissipating material, like glue, may be applied to further enhance heat transmission between the heat contact part of the heat sink and the light source plate.

Heat received from the heat contact part of the heat sink is further transmitted to the heat dissipating part. The heat dissipating part further transmits received heat to one or more other components.

In some embodiments, the heat sink is placed above the light source plate. Specifically, a bottom side of the heat contact part is heat connected to a top side of the light source plate. The term "heat connected" refer to heat conduction between two components with directly engagement or indirectly engagement with some other components like heat dissipating material placed between the two components.

The reflective cup includes a neck portion heat connected to the heat dissipating part. Specifically, in some embodiments, the reflective cup has a widen bottom edge and a narrow top edge. The neck portion refers to the area close to the narrow top edge. The reflective cup may have an opening corresponding to the shape of the light source plate.

In addition, the reflective cup has a top surface heat connected to the heat dissipating part of the heat sink. With such design, heat of the light source plate is carried from the heat contact part of the heat sink to the heat dissipating part of the heat sink. In addition, heat is further transmitted from the heat dissipating part of the heat sink to the reflective cup. The heat dissipating part of the heat sink may directly engage the top surface of the reflective part, or indirectly engage the top surface of the reflective cup, e.g. applying some heat dissipating glue between the top surface of the reflective cup and the heat dissipating part of the heat sink.

The reflective cup has an inner reflective surface surrounding the light source plate for reflecting a light emitting from the light source plate to predetermined directions. Specifically, the inner reflective surface may form a surrounding dome or cup shape with a light opening.

Light emitted from the light source plate may escape from the light opening directly, or be emitted to the inner reflective surface of the reflective cup and reflected for one or multiple times before the light is escaped from the light opening.

There may be a diffusion cover covering the light opening, or other designs like some mentioned below.

The inner reflective surface may be attached with reflective material like white paint, or disposed with optical guiding structures for showing shining surface or enhancing light reflection.

In some embodiments where driver circuits are not directly integrated with the light source plate, the driver circuits are placed in the driver container. The driver container may be a box of any geometrical shape, e.g. with a bottom shape similar to the top edge of the reflective cup and the light source plate.

In some embodiments, the driver container may also contain wireless or wire communication circuits and related processing circuits for converting an external command to a corresponding signal to control the LED downlight apparatus.

The driver circuit is electrically connected to the LED chips via a conductor path, e.g. wires or conductive strips. In some embodiments, the driver container may have a passing hole for the conductor path to pass through. Furthermore, the heat sink may also have a passing hole for the conductive path to route and to connect to the LED chips of the light source plate. In some embodiments, the passing hole may contain one or more sub holes corresponding to wire.

Plugging sockets may also be used for electrically connecting the driver circuit to the LED chips. The driving current converted by the driver circuit is sent to the LED chips.

The light source plate has a heat dissipating substrate for conducting heat of the LED chips to the heat contact part of the heat sink.

Figure 5:
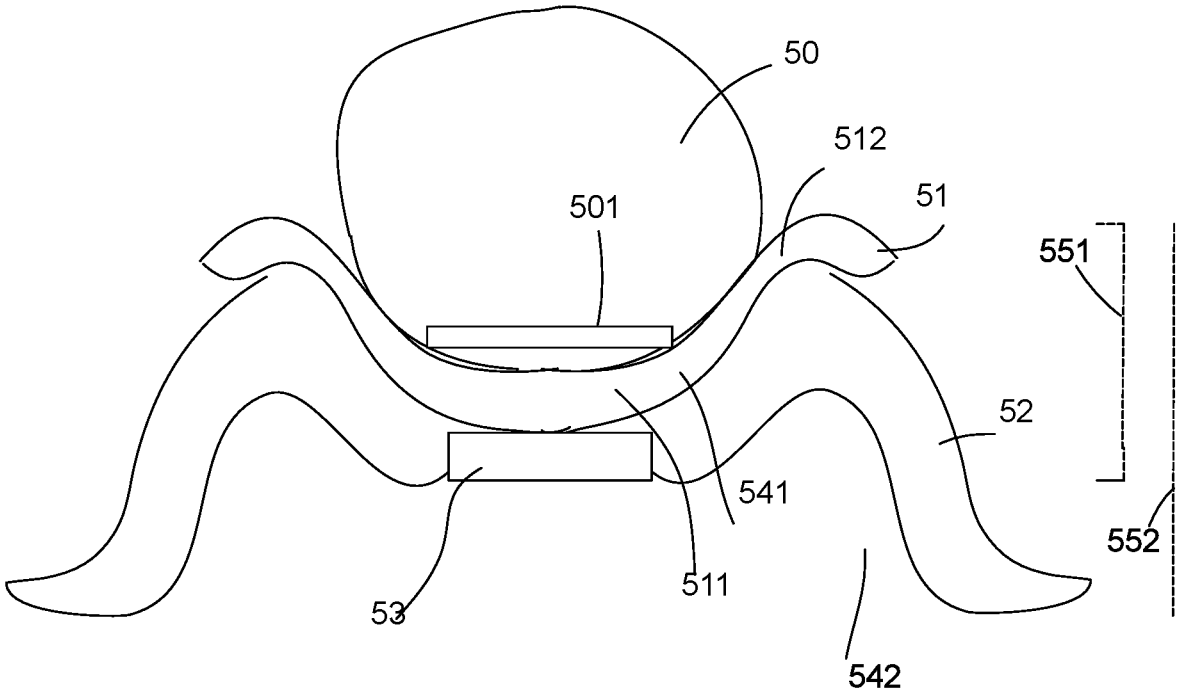
FIG. 5 is a diagram illustrating relation among components.

Please refer to FIG. 5. FIG. 5 is a diagram illustrating relation among components.

In FIG. 5, the LED downlight apparatus includes a light source plate 53, a heat sink 51, a driver container 50 and a reflective cup 52.

The reflective cup 52 have double inverted curved surfaces, forming a first cup 542 for reflecting the light of the light source plate and a second cup 541 for containing the driver container 50. The lateral wall of the driver container 50 and the light source plate 53 engage the heat contact part 511 of the heat sink 51. The heat is carried to the heat dissipating part 512 of the heat sink 51.

The reflective cup height 552 and the heat sink height 551 may be controlled based on design requirements. For example, the heat sink height 551 may be less than 50% of the reflective cup height 552. A driver circuit board 501 is placed at bottom of the driver container 50.

Please refer to FIG. 1, FIG. 2, FIG. 3 and FIG. 4.

Figure 2:
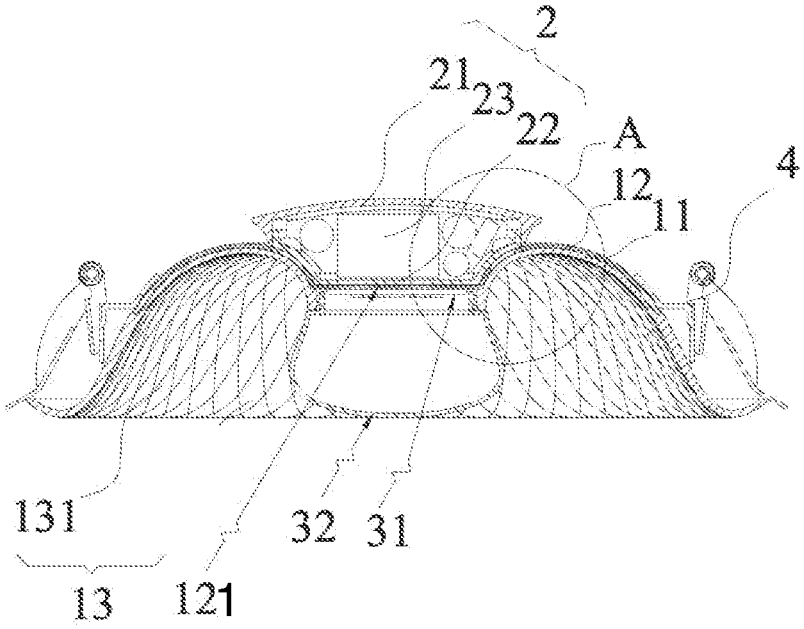
FIG. 2 is a cross-sectional view of the embodiment of FIG. 1.
Figure 3:
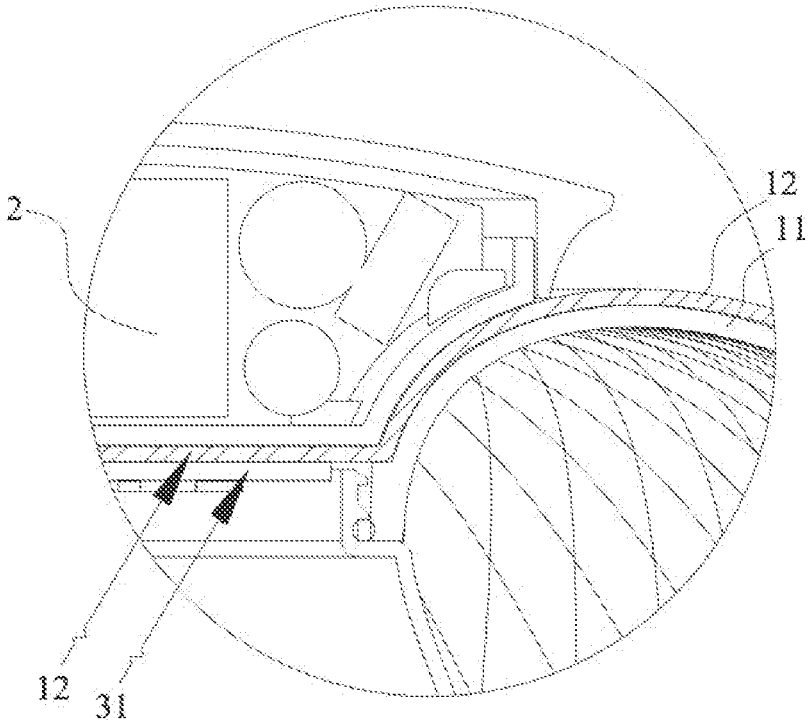
FIG. 3 illustrates a zoomed view of some components.
Figure 4:
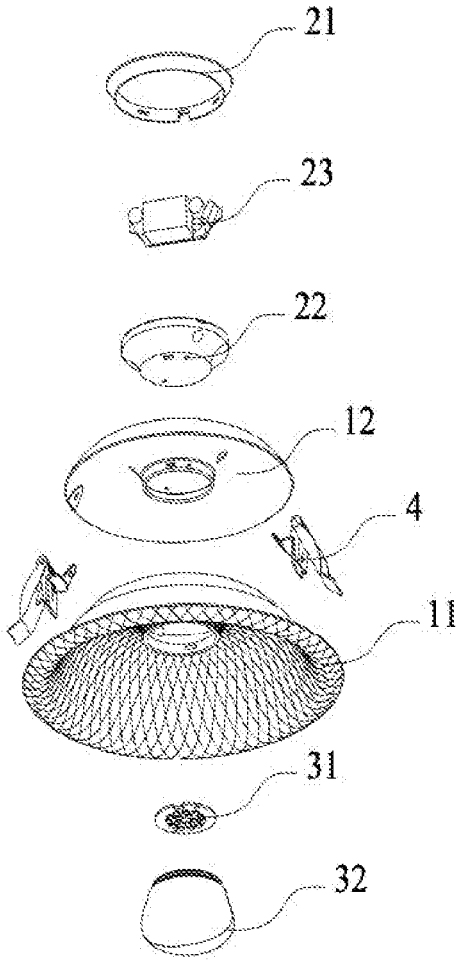
FIG. 4 is an exploded view of components of the embodiment of FIG. 1.

FIG. 1 is a perspective view of a LED downlight apparatus. FIG. 2 is a cross-sectional view of the embodiment of FIG. 1. FIG. 3 illustrates a zoomed view of some components. FIG. 4 is an exploded view of components of the embodiment of FIG. 1.

In FIG. 1, there are wing springs 4 for fixing the downlight apparatus to a ceiling.

The reflective cup 1 has an inner reflective surface 13 covered with polygonal structures 131. A shielding cover 1 covers a light source plate (not shown) for visual effect, preventing glare effect or guiding light to desired directions.

In FIG. 2, the driver container 2 has a top cover 21 and a bottom plate 22 for containing driver circuits 23.

The circle A is illustrated in enlarged view in FIG. 3. The heat sink 12 is placed between the driver container and the light source plate 3.

The heat sink 12 has a heat contact part 121 engaging the light source plate 31. The light source plate 31 is covered by the shielding cover 32. Other reference numerals refer to the same component in FIG. 1 to FIG. 4.

In FIG. 3, it shows the heat sink 12 has a heat dissipating part with the same curve shape as the underlying reflective cup 11 for passing heat to the reflective cup 11.

In FIG. 4, components of the embodiment of FIG. 1 are listed for a more clear view.

In some embodiments, the driver container engages a top side of the heat contact part of the heat sink. There are various ways to implement this feature. For example, the heat sink is arranged between the driver container and the light source plate. In such design, heat of the light source plate may also be transmitted to the driver container. When the driver container is made of metal material, the driver container may also be used for heat dissipation.

In some embodiments, the driver container has a bottom side and a lateral wall. At least a part of the lateral wall of the driver container engages the heat contact part of the heat sink. For example, when the driver container is a circular box, the bottom side of the circular box may engage a first part of the heat contact part of the heat sink and the lateral side are partly or completely engage a second part of the heat contact part of the heat sink.

For example, the heat contact part of the heat sink may be a cup shape structure so that the driver container is placed in the cup structure.

In some other embodiments, at least another part of the lateral wall is not contacting the heat sink. In such case, the driver container may not need to completely surrounded by the heat contact part of the heat sink.

In some embodiments, a heat sink height of the heat sink is less than 50% of a reflective cup height of the reflective cup. With the design mentioned above, the overall height of the LED downlight apparatus may be decreased.

In some embodiments, the heat sink may spread and cover most of the reflective cup. In some other embodiments, to decrease cost, the heat sink only covers part of the reflective cup, e.g. less than 50% of height of the reflective cup.

In some embodiments, the driver circuit is mounted on a circuit plate. The circuit plate is attached to the bottom side of the driver container. With such design, the heat of the driver circuit may easily carried away by the heat contact part, too.

In some embodiments, the reflective cup and the heat sink are circular shape structures.

In some embodiments, the inner surface of the reflective cup are disposed with polygonal structures.

Specifically, in a first design, the polygonal structures have convex protruding surface. Such design brings a first optical guiding and visual effect.

In some other design, the polygonal structures have concave surface, which brings a second optical guiding and visual effect.

The polygonal structures may look like fins of a fish or a crystal decoration.

In some embodiments, the polygonal structures close to the light source plate and away from the light source plate are different. For example, the polygonal structure may have different sizes for those near the top edge of the reflective cup compared to those near the bottom edge of the reflective cup.

In some embodiments, the heat sink forms a concave cup facing upwardly and the light source plate is placed in the concave cup. In such design, the reflective cup may have two inverted curve surfaces. The first curve surface forms a first cup for reflecting the light of the light source plate and the second curve surface forms a second cup for holding the driver container.

Such design may further decrease the overall height of the downlight apparatus.

In some embodiments, the reflective cup comprises a streamline bell shape structure.

In some embodiments, the downlight apparatus also has a shielding cover covering the light source plate. The light emitted from the plurality of LED modules passes through the shielding cover.

In some embodiments, the shielding cover has a bottom lens for forming a light beam and a lateral wall of the shielding cover for passing light on the reflective cover forming a second luminous source. For example, the light of the second luminous source emits to the inner reflective surface while the light via the bottom lens is directly emitting outside the LED downlight apparatus.

In some embodiments, the reflective cup has a hook structure for plugging and fixing the shielding cover. The hook may have an inverted hook to prevent detachment between the reflective cup and the light source plate.

In some embodiments, the downlight apparatus may also have a heat conductive layer disposed between the light source plate and the heat sink. Glue or other heat conductive material may be used for forming the heat conductive layer.

In some embodiments, the heat sink is made of metal material.

In some embodiments, the heat sink has a plurality of protruding bars on a surface of the heat sink to increase the rigidity of the heat sink and the reflective cover. Such protruding bars may form a grid or other shape to strengthen the rigidity of the attached reflective cup.

In some embodiments, the light source plate also engages an edge of the reflective cup.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A LED downlight apparatus, comprising:

a light source plate mounted with a plurality of LED chips on a bottom side of the light source plate;

a heat sink comprising a heat contact part and a heat dissipating part, a bottom side of the heat contact part heat connected to a top side of the light source plate;

a reflective cup comprising a neck portion heat connected to the heat dissipation part and comprising an inner reflective surface surrounding the light source plate for reflecting a light emitting from the light source plate to predetermined directions;

a driver container comprising a driver circuit electrically connected to the plurality of LED chips via a conductor path through a passing hole of the heat sink for supplying a driving current to the plurality of LED chips on the light source plate, wherein the light source plate has a heat dissipating substrate for conducting heat of the plurality of LED chips to the heat sink; and a shielding cover covering the light source plate, the light emitted from the plurality of LED modules passes through the shielding cover, wherein the shielding cover has a bottom lens for forming a light beam and a lateral wall of the shielding cover for passing light on the reflective cup forming a second luminous source, a surface of the reflective cup has a distance from the shielding cover.

2. The downlight apparatus of claim 1, wherein the driver container engages a top side of the heat contact part of the heat sink.

3. The downlight apparatus of claim 2, wherein the driver container has a bottom side and a lateral wall, at least a part of the lateral wall of the driver container engages the heat contact part of the heat sink.

4. The downlight apparatus of claim 3, wherein at least another part of the lateral wall is not contacting the heat sink.

5. The downlight apparatus of claim 4, wherein a heat sink height of the heat sink is less than 50% of a reflective cup height of the reflective cup.

6. The downlight apparatus of claim 2, wherein the driver circuit is mounted on a circuit plate, and the circuit plate is attached to the bottom side of the driver container.

7. The downlight apparatus of claim 1, wherein the reflective cup and the heat sink are circular shape structures.

8. The downlight apparatus of claim 1, wherein the inner surface of the reflective cup is disposed with polygonal structures.

9. The downlight apparatus of claim 8, wherein the polygonal structures have convex protruding surface.

10. The downlight apparatus of claim 8, wherein the polygonal structures have concave surface.

11. The downlight apparatus of claim 8, wherein the polygonal structures close to the light source plate and away from the light source plate are different.

12. The downlight apparatus of claim 1, wherein the heat sink forms a concave cup facing upwardly and the light source plate is placed in the concave cup.

13. The downlight apparatus of claim 12, wherein the reflective cup comprises a streamline bell shape structure.

14. The downlight apparatus of claim 1, wherein the reflective cup has a hook structure for plugging and fixing the shielding cover.

15. The downlight apparatus of claim 1, further comprising:

a heat conductive layer disposed between the light source plate and the heat sink.

16. The downlight apparatus of claim 1, wherein the heat sink is made of metal material.

17. The downlight apparatus of claim 16, wherein the heat sink has a plurality of protruding bars on a surface of the heat sink to increase the rigidity of the heat sink and the reflective cover.

18. The downlight apparatus of claim 1, wherein the light source plate engages an edge of the reflective cup.

* * * * *